United States Patent [19]

Helms

[11] 4,438,864

[45] Mar. 27, 1984

[54] TAMPERPROOF CLOSURE

[75] Inventor: Charles R. Helms, Malvern, Pa.

[73] Assignee: Container Corporation of America, Chicago, Ill.

[21] Appl. No.: 386,632

[22] Filed: Jun. 9, 1982

[51] Int. Cl.[3] ..... B65D 41/32

[52] U.S. Cl. ..... 220/265; 206/807; 215/250; 220/260; 229/5.5; 229/43

[58] Field of Search ..... 220/265, 266, 270, 307, 220/66, 67, 260; 229/43, 5.5; 215/253, 358, 355, 354, 250; 206/807

[56] References Cited

U.S. PATENT DOCUMENTS

| | | | |
|---|---|---|---|
| 3,139,208 | 6/1964 | Irwin et al. | 220/307 X |
| 3,244,308 | 4/1966 | Esposito, Jr. | 215/354 X |
| 3,380,610 | 4/1968 | Krieps | 215/355 X |
| 3,415,405 | 12/1968 | Rausing et al. | 215/253 |
| 3,485,436 | 12/1969 | Mirasol, Jr. | 229/43 X |
| 3,701,453 | 10/1972 | Platt et al. | 220/270 |
| 3,851,812 | 12/1974 | Bittel | 229/5.5 |
| 4,027,776 | 6/1977 | Douglas | 215/355 X |
| 4,078,688 | 3/1978 | Nilsson et al. | 215/358 X |
| 4,211,336 | 7/1980 | Helms | 229/43 X |
| 4,360,121 | 11/1982 | Helms | 229/43 |

FOREIGN PATENT DOCUMENTS

| | | | |
|---|---|---|---|
| 449825 | 7/1949 | Italy | 220/307 |

*Primary Examiner*—Allan N. Shoap

*Attorney, Agent, or Firm*—Richard W. Carpenter; Davis Chin

[57] ABSTRACT

In a tamperproof closure arrangement for a cylindrical container having an internal flange, an insertable lid including an outer skirt portion joined to a central portion by an integral hinge which permits the skirt portion to pivot relative to a base portion.

5 Claims, 9 Drawing Figures

TAMPERPROOF CLOSURE

BACKGROUND OF THE INVENTION

1. Field of the Invention

This invention relates generally to cylindrical paperboard, plastic, or composite containers having tamperproof closure arrangements which include an insertable lid engageable with an internal flange of the container.

2. Description of the Prior Art

A prior art search directed to the subject matter of this application in the United States Patent and Trademark Office disclosed the following U.S. Pat. Nos. 3,080,090; 3,297,193; 3,531,013; 3,622,028; 3,940,005; 4,027,776; 4,245,753; 4,293,080.

None of the prior art patents uncovered in the search disclosed a tamperproof closure arrangement including an insertable lid having a central base portion and a peripherable skirt portion pivotally attached to the base portion by an integral hinge providing a toggle action which permits the lid to be inserted into the end of the container and locked in position by the engagement of a lid flange with an internal flange of the container.

SUMMARY OF THE INVENTION

It is an object of the invention to provide a tamperproof closure arrangement for a cylindrical container, such as a composite or plastic can, having an internal flange adjacent the open end thereof.

Another object of the invention is the provision of an insertable lid having a skirt portion with a locking flange engageable with an abutment on the container internal flange to prevent the removal of the lid from the container.

A more specific object of the invention is the provision of an insertable lid for a tamperproof closure arrangement which lid includes a central base portion and an outer skirt portion joined to the base portion by an annular hinge which permits the skirt portion to have a pivoting movement relative to the base portion.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENTS

Figure 1:
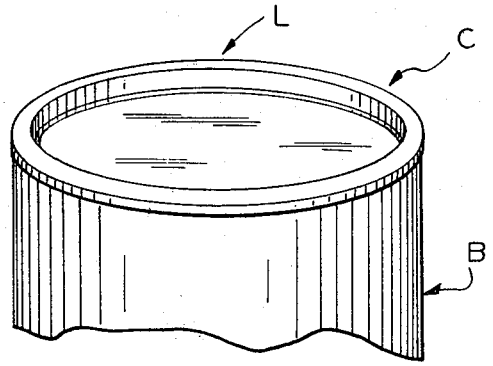
FIG. 1 is a fragmentary perspective view of a container and lid having a tamperproof closure arrangement embodying features of the invention.
Figure 3:
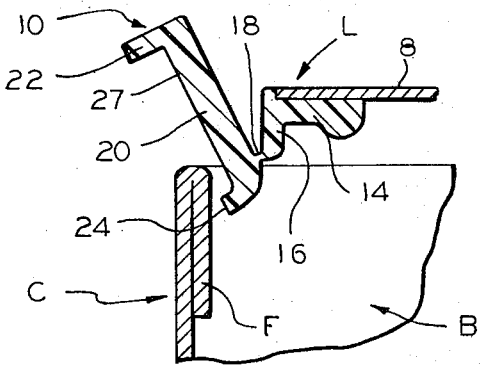
FIG. 3 is a view similar to FIG. 2, but illustrating the manner in which the lid is inserted into the end of a container.

Referring now to the drawings for a better understanding of the invention, and particularly to FIGS. 1 and 3, it will be seen that a cylindrical container, indicated generally at C, is provided with an insertable lid L which affords a tamperproof closure arrangement embodying features of the invention.

Container C includes a body wall indicated generally at B having, adjacent the upper or open end thereof, an internal flange F.

Figure 5:
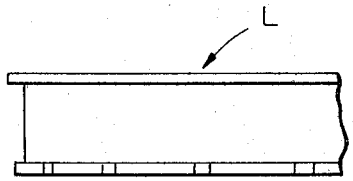

Lid L, as best seen in FIGS. 1 and 5, includes a central portion having a round center panel 8 and a peripherial rim indicated generally at 10.

Although center panel 8 may be formed of either plastic or paperboard, in the embodiment illustrated in the drawings the central panel 8 is formed of paperboard. The marginal portion of the panel is secured to the rim by an insert injection molding process. Rim 10 includes a base portion 12 having a horizontal section 14 with a recess 15 adapted to receive the peripherial portion of center panel 8. The rim base 12 also includes a vertical section 16, formed integrally with horizontal section 14, and a relatively thin annular integral hinge 18 for securing the vertical section 16 of the base portion of the rim to a skirt portion indicated generally at 20.

Skirt 20 is a cylindrical wall having formed integrally with and projecting radially outwardly from the upper and lower ends thereof an upper flange 22 and a lower flange 24, respectively, which define therebetween an annular groove or recess 27 adapted to receive the flange F of container body wall B in a manner hereinafter described.

When the center panel is paperboard, the paperboard panel is inserted into the mold at the same time the remaining portion of the rim is formed, so as to make the center panel an integral part of the rim by an insert injection molding process of the type described in U.S. Pat. No. 3,397,814.

Figure 2:
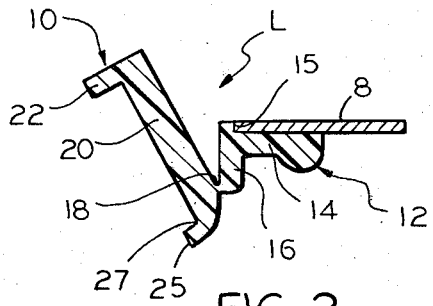
FIG. 2 is a fragmentary vertical sectional view of the rim portion of a lid embodying features of the invention.

In molding the rim, and particularly the skirt portion lower retaining flange 24, the rim is formed with the skirt portion angled outwardly from the base portion of the rim as illustrated in FIGS. 2 and 3.

In order to have a tamperproof closure, the insertable closure has a skirt with an outwardly projecting flange that, once positioned within the end of the container, cannot be removed therefrom without destroying the integrity of portions of the lid or container.

An example of this concept can be seen in U.S. Pat. No. 3,297,193. One problem with this type of closure, however, is that of inserting the closure into the end of the container when the diameter of the closure is greater than that of the container mouth.

This is accomplished in the present invention by the unique hinge arrangement of the rim whereby the annular hinge section 18 joins the base portion 14 to the skirt portion 20 of the lid rim.

Figure 4:
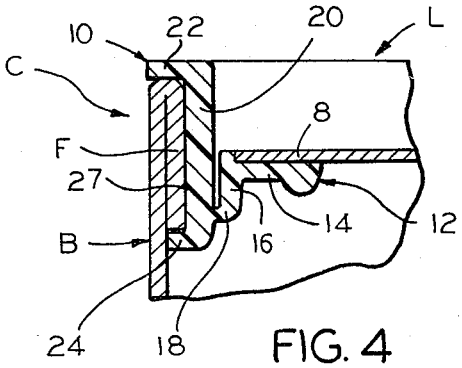
FIG. 4 is a view similar to FIG. 3, but illustrating the relative positions of the lid and container after the former has been inserted into the latter and locked in position.

In the present invention the lid can be inserted into the container with the skirt flange in the position shown in FIG. 3. As the lid moves further into the container, the skirt portion can pivot about hinge 18, so that the lower end of the skirt skirt portion and particularly the lower retaining flange 24 can move upwardly and outwardly and thereby engage the underside or innerside of can flange F to provide a snug locking relationship therebetween as best seen in FIG. 4.

This unique hinging arrangement permits the insertion into the open end of a container of a lid having a retaining flange with a diameter greater than the diameter of the container mouth.

Figure 6:
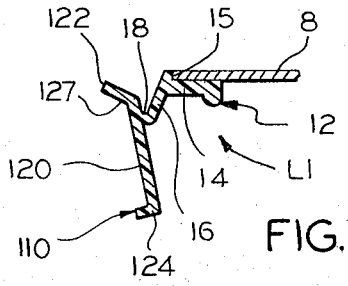
FIGS. 6, 7, 8, and 9 are views similar to FIGS. 2, 3, 4, and 5, respectively, but illustrate modified forms of the invention.
Figure 7:
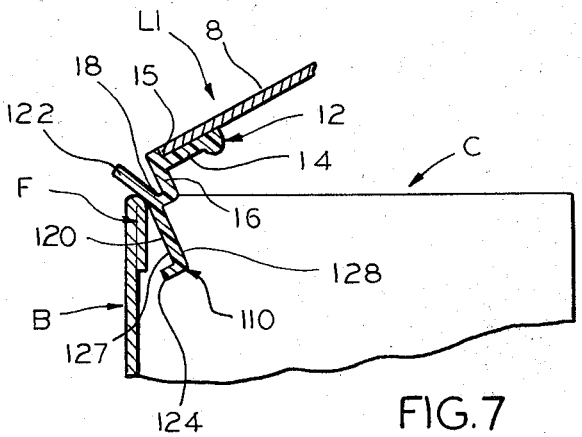
Figure 8:
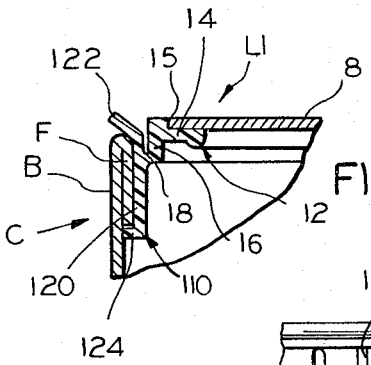

Referring now to FIGS. 6, 7, and 8, it will be seen that a slightly modified form of the invention is shown. In this embodiment portions of the structure corresponding to those of the previously described embodiment have been identified by similar numerals.

The container in this embodiment is the same as that of the previously described embodiment. Also, the central portion of the lid L1 is the same as that of the previous embodiment. It includes a center panel 8 and a rim 10 having a base portion 12 with an integral hinge 18 pivotally connecting the base portion to a skirt portion 120.

The skirt portion is somewhat similar to that of the previously described and a cylindrical wall 120 which is joined at its upper end by the hinge 18 to the base portion 12 of the rim.

Skirt 120 also includes a pair of outwardly extending upper and lower flanges 124 and 126, respectively, which define therebetween an annular channel or recess 127 for receiving the flange F of the container in the same manner as that of the previously described embodiment. The lid of this embodiment is inserted into the end of the container in the same way as that of the previous embodiment and functions in the same general manner.

Figure 9:
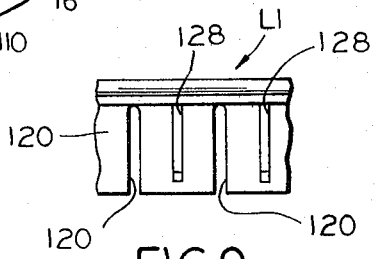

Turning now to FIG. 9, it will be seen that a slightly modified form of the invention is shown. In this embodiment, in order to facilitate more flexing of the skirt 120, there are provided a plurality of slots 129 which divide the skirt into circumferentially spaced segments, with each of the segments being reinforced by an internal vertical rib 128. This rib and/or slot concept may be utilized for either of the previously described embodiments of the lid.

Thus, it will be appreciated that the invention provides a tamperproof closure arrangement with an insertable lid having a pivotable skirt portion which allows it to be inserted into a container, even though a portion of the lid has a diameter greater than that of the opening of the container within which it is received.

What is claimed is:

1. In a tamperproof closure arrangement for a generally cylindrical container with a body wall having, adjacent the open end thereof, an internal flange presenting an axially inwardly facing abutment, an insertable lid comprising:

(a) a central portion, including a generally circular center panel;

(b) an annular outer rim;

(c) said rim being formed of molded plastic and including:

(i) a base portion joined to said center panel;

(ii) a skirt portion disposed radially outward of and pivotal with respect to said base portion, said skirt portion being molded at an oblique angle to said base portion;

(iii) a relatively thin, annular, integral hinge interconnecting said skirt portion and said base portion for accommodating pivotal movement of said skirt portion relative to said base portion to permit insertion of the lid into the container;

(d) said skirt portion including:

(i) a generally frusto-conical wall prior to insertion into the container;

(ii) an integral annular retaining flange extending radially outward from a lower portion of said frusto-conical wall for engagement with said container body wall, said lower portion being spaced axially downwardly from said hinge;

(iii) a second flange extending radially outward from an upper portion of said frusto-conical wall and defining with said retaining flange an annular channel for receiving said container body wall flange, said upper portion being spaced radially outwardly from said base portion and being spaced axially upwardly from said hinge;

whereby when the lid is inserted into the open end of the container, the contact of the container with the lid causes said skirt portion to pivot with said retaining flange moving radially outwardly and with said second flange moving radially inwardly so that said retaining flange lockingly engages with the underside of said container body wall flange to prevent removal of the lid from the container without causing visible damage thereto.

2. A closure arrangement according to claim 1, wherein said central portion center panel is formed of paperboard.

3. A closure arrangement according to claim 1, wherein said base portion includes a horizontal section joined to said center panel and a vertical section joined to said hinge.

4. A closure arrangement according to claim 1, wherein said skirt portion has a lower portion divided into circumferentially spaced segments by axially spaced slots.

5. A closure arrangement according to claim 4, wherein said segments are each reinforced by an axially extending internal rib.

* * * * *